US005484180A

United States Patent [19]

Helmar

[11] Patent Number: 5,484,180

[45] Date of Patent: Jan. 16, 1996

[54] ELECTRIC STRIKE MECHANISM

[75] Inventor: Henry L. Helmar, Phoenix, Ariz.

[73] Assignee: Hanchett Entry Systems, Inc., Phoenix, Ariz.

[21] Appl. No.: 276,430

[22] Filed: Jul. 18, 1994

Related U.S. Application Data

[63] Continuation-in-part of Ser. No. 72,109, Jun. 7, 1993, abandoned.

[51] Int. Cl.[6] ..... E05B 15/02

[52] U.S. Cl. ..... 292/341.16; 292/201

[58] Field of Search ..... 292/341.16, 201, 292/341.15, 144, DIG. 25

[56] References Cited

U.S. PATENT DOCUMENTS

| | | | |
|---|---|---|---|
| 3,152,826 | 10/1964 | Smith | 292/201 X |
| 3,774,422 | 11/1973 | Hogan et al. | 292/341.16 X |
| 4,017,107 | 4/1977 | Hanchett | 292/341.16 |
| 4,026,589 | 5/1977 | Hanchett, Jr. | 292/341.16 |
| 4,595,220 | 6/1986 | Hanchett, Jr. et al. | 292/341.16 |
| 4,626,010 | 12/1986 | Hanchett, Jr. et al. | 292/341.16 |

FOREIGN PATENT DOCUMENTS

| | | | |
|---|---|---|---|
| 313939 | 5/1956 | Switzerland | 292/341.16 |

*Primary Examiner*—Rodney M. Lindsey
*Attorney, Agent, or Firm*—Warren F. B. Lindsley

[57] ABSTRACT

A door locking mechanism employing an internally mounted solenoid for providing both fail secure and fail safe operations employing a pivotally mounted keeper for selectively opening and closing a strike block with keeper being controlled by a locking yoke which is selectively movable by the solenoid.

9 Claims, 2 Drawing Sheets

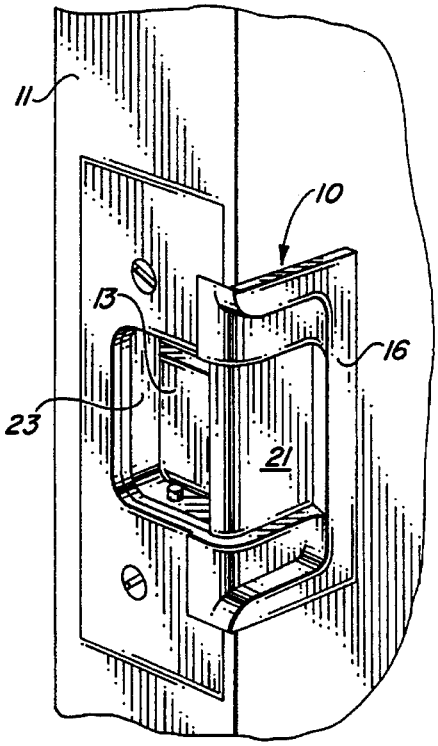
FIG. 1
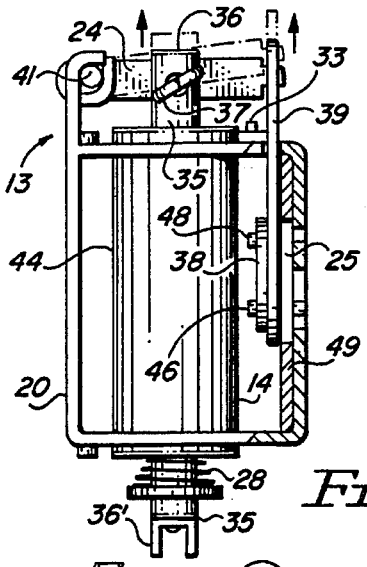
FIG. 4
FIG. 5
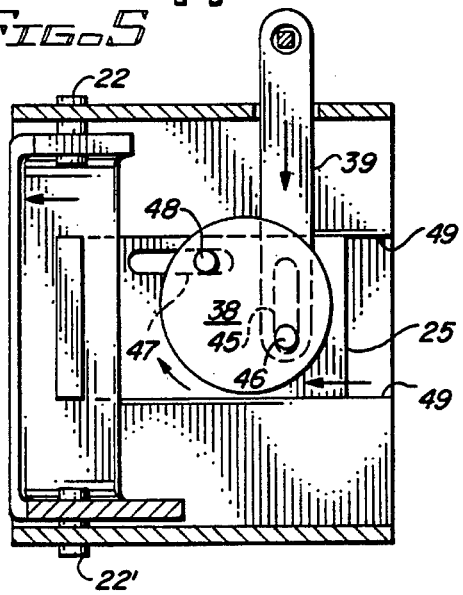
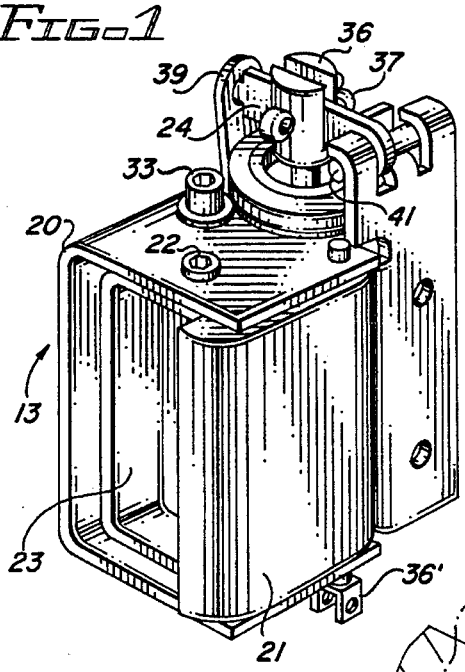
FIG. 3
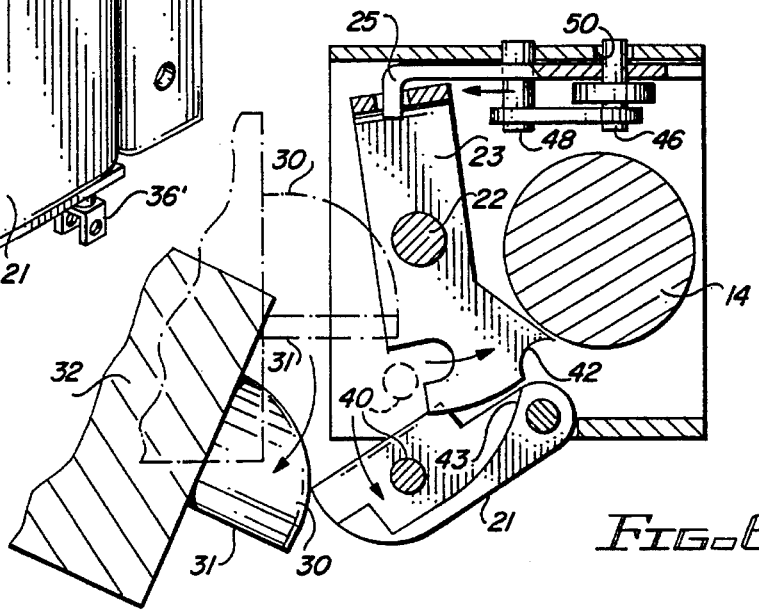
FIG. 6

ELECTRIC STRIKE MECHANISM

This application is a continuation in part of U.S. patent application Ser. No. 08/072,109 filed Jun. 7, 1993 now abandoned and entitled ELECTRIC STRIKE MECHANISM.

This invention relates to door locking mechanisms and more particularly to a modular design for a door locking mechanism which employs an internally mounted solenoid for both fail secure and fail safe operations. The disclosed modular design enables the user to determine the function, either fail secure or fail safe at the time of installation of the lock mechanism by the positioning of the solenoid within the strike.

DESCRIPTION OF THE PRIOR ART

Door locking mechanisms are well known in the prior art but none are known of a modular design which is compact, easy to install and utilizes a solenoid that provides both fail secure and fail safe operations.

U.S. Pat. No. 4,017,107 discloses an electric door strike employing a pivoting shutter moveable between an open position to admit a dead bolt when the latter is in its extended position and a closed position wherein a notch for receiving the dead bolt is partially covered. In the closed position the dead bolt may not be withdrawn from a strike frame except by being withdrawn into the door lock mechanism. A shutter is mounted on the shaft of a rotary solenoid which, when energized, pivots the shutter and engages a mating detent in the strike frame when the shutter is closed to prevent the shutter from being forced open from a position externally of the door. A latch spring is mounted within the strike frame in an interfering position with both the dead bolt and the shutter, the spring being urged by contact with the dead bolt out of the path of the shutter to permit the latter to pivot into its closed position.

U.S. Pat. No. 4,026,589 discloses a door locking mechanism that employs a dead bolt and spring latch released by the action of a single keeper. The keeper has two stable limit positions, i.e., open or closed. Once released, (by engaging the solenoid) the keeper is held in its open position allowing the door to be opened and closed with the dead bolt in its extended position. The dead bolt moving toward the door closed position engages an abutment member which urges the keeper toward the closed and locked position.

U.S. Pat. No. 4,595,220 discloses a dead bolt sensing and strike closing mechanism employing a rotatable keeper moveable between open and closed positions. An abutment member is connected to a rotatable keeper and is selectively rotatable with the rotatable keeper. A sensing arm is connected to the strike case for sensing the presence of the dead bolt in the strike case. The sensing arm selectively disengages the abutment member for allowing the abutment member to rotate with the rotatable keeper if the dead bolt is detected within the strike case.

U.S. Pat. No. 4,626,010 discloses a concealed door release mechanism including a strike block adapted to receive a latch bolt. A ramped surface is provided within the strike block for urging the latch bolt into the door to thereby open the door. Structure is provided in the strike block for preventing the latch bolt from moving into contact with the ramped surface for maintaining the door closed.

SUMMARY OF THE INVENTION

In accordance with the invention claimed, a new and improved locking mechanism is provided which provides both fail secure and fail safe operations with the use of a single solenoid.

It is, therefore, one object of this invention to provide a new and improved electrically energized locking mechanism.

Another object of this invention is to provide a modular electric strike employing an internally mounted solenoid which provides both fail secure and fail safe functions.

A further object of this invention is to provide an electric strike mechanism providing fail secure and fail safe functions with a minimum of moving parts.

A still further object of this invention is to provide such a strike mechanism which may be inexpensively constructed in a compact modular form.

A still further object of this invention is to provide an improved electrical strike mechanism which may be converted from fail secure to fail safe, or fail safe to fail secure without additional components.

A still further object of this invention is to provide an improved electrical strike mechanism which employs a locking yoke that provides double lock security to the strike by preventing unauthorized rotation of the locking yoke except upon activation of a solenoid.

Yet another object of this invention is to provide an electrical strike mechanism which employs a certain synchronizing function using a Geneva mechanism to maintain a proper relationship between the locking yoke and the keeper of the lock mechanism.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which:

FIG. 1 is a perspective view of an electric strike installed in a door jamb and constructed in accordance with the teachings of the present invention;

FIG. 3 is a perspective view of the operating module portion of the electric strike;

FIG. 4 is a right end view of FIG. 3;

FIG. 5 is a cross sectional view of FIG. 4 showing the connector link and cam so positioned as to place the locking yoke in the unlocked position;

FIG. 6 is a cross sectional view of FIG. 4 showing the locking yoke moved by the solenoid to its unlocked position;

DESCRIPTION OF THE PREFERRED EMBODIMENT

Figures 2, 7, 8, 9, 10:
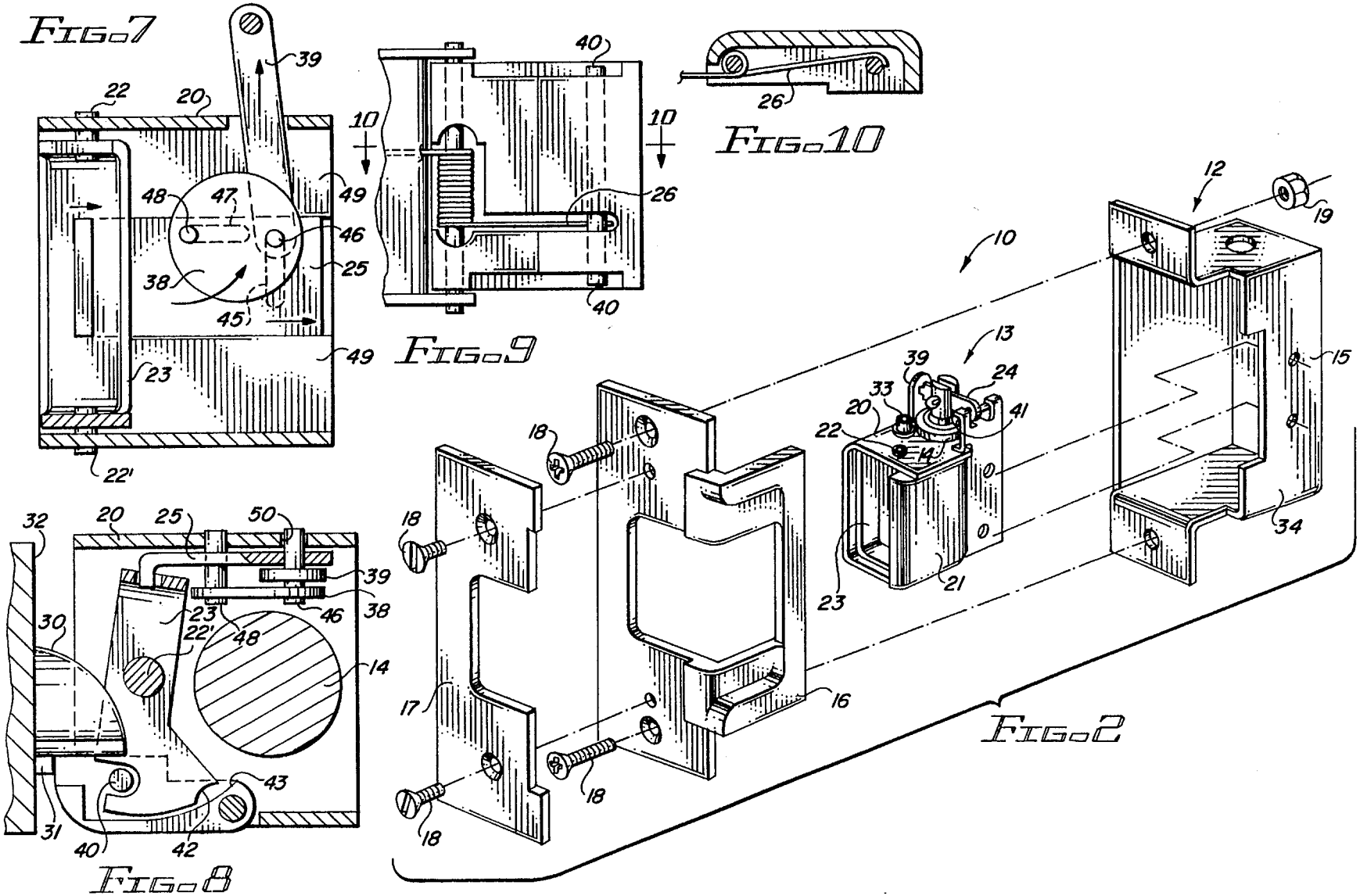
FIG. 2 is an exploded perspective view of the components of the electric strike shown in FIG. 1.
FIG. 7 is the same view as FIG. 5 but showing the connector link and cam so positioned as to place the locking yoke in the locked position.
FIG. 8 is the same view as FIG. 6 but showing the locking yoke moved to the locked position.
FIG. 9 is a view of the keeper of FIGS. 1 and 2 shown in the open or unlocked position.
FIG. 10 is a cross section of the keeper of FIG. 9 taken along the line 10—10 showing the keeper return spring.

Referring more particularly to the drawings by characters of reference, FIGS. 1–10 disclose an improved electric strike 10 mounted in a door jamb 11 and comprising three basic assemblies, namely an enclosure 12, and operating module 13 and a solenoid assembly 14.

The strike enclosure comprises a case 15, cover 16 and face plate 17 in addition to mounting hardware, bolts 18 and nuts 19. The case which may be constructed of a formed and welded stainless steel sheet is provided for mounting and protecting the operating components of the electric strike mechanism. Cover 16, which may be an aluminum casting is used for sealing the enclosure to protect the components and for providing easy access for service purposes. The face plate is stamped from a stainless steel sheet to provide a decorative trim.

The operation module 13, as shown in FIGS. 2, 3 and 4, comprises a housing 20, keeper 21, keeper return spring 26 (shown in FIG. 10), locking yoke 23, pivot pins 22 and 22' and yoke actuator 25. Also included in the operating module 13 are solenoid link 24, connector link 39, cam 38 and associated assembly hardware. The keeper 21 is secured to enclosure 20 at four points thus distributing any forces generated by pushing on the door in the opening direction.

Solenoid assembly 14, as shown in FIGS. 2 and 3, is mounted in the operating module 13 and held therein by bolt 33 which threadedly fits into the operating module enclosure 20. The solenoid assembly 14 comprises body 34, plunger 35, solenoid return spring 28 and clevises 36 and 36'. Plunger 35 of solenoid assembly 14 is biased to its deenergized position shown in FIG. 4 by conical coiled spring 28 surrounding the plunger. When the spring is compressed it flattens to a height of one coil. Clevis 36' is secured by pin 37 to solenoid link 24 when fail secure (locked with power off) operation is desired. When fail safe (locked with power on) operation is desired, the solenoid is rotated end for end in enclosure 20 and clevis 36 is connected to solenoid link 24 by pin 37.

Whether the electric strike is operating in a fail safe, or fail secure mode, the operating module 13 performs the same function, that of locking or unlocking keeper 21. FIG. 1 shows keeper 21 in its closed position with the keeper return spring tending to maintain the keeper in that position.

As shown in FIG. 8, the operating module 13 contained in enclosure 12 secures a latch bolt 30 and a sliding element 31 in its depressed position carried by a door 32 when door 32 is in the closed position. Latch bolt 30 and sliding element 31 are retracted within door 32 as door 32 is opened by door knob (not shown).

General Operation

The clevis 36 containing a pin 37 extending between its legs on the top of plunger 35 is connected to solenoid link 24 in the manner shown in FIG. 4. Solenoid link 24 engages pin 37 and connector link 39 extending laterally out of the other end of solenoid link 24 to pivot the cam 38. Locking yoke 23 comprises a U-shaped frame having its legs extending one along the base inside housing 20 and the other along the top and inside of housing 20, as shown in FIGS. 2 and 3.

Locking yoke 23 is pivotally mounted in housing 20 at approximately the center point of each of its legs by locking yoke pivot pins 22 and 22' to move in a predetermined arcuate manner under the effects of locking yoke actuator 25. Locking yoke actuator 25 is 24, actuated by solenoid 14 through solenoid link connecting link 39 and cam 38 and is guided by guides 49 as shown in FIGS. 4, 5 and 7. With cam 38 rotated to its full counterclockwise position (FIG. 7), locking yoke actuator 25 secures locking yoke 23 in the locked position. This prevents possible picking of the electric strike by moving locking yoke 23 with a tool from outside the electric strike. Movement of locking yoke 23 by locking yoke actuator 25 in the manner shown in FIG. 6 causes locking yoke 23 to disengage from lock pins 40 mounted within grooves in the sides of keeper 21. This movement is caused by the full clockwise rotation of cam 38 (FIG. 5). Cam 38 is moved to its full counterclockwise position by the full extension (out of the operating module 13) of connector link 39 and the full counterclockwise rotation of solenoid link 24 about its pivot pin 41 (FIG. 4).

Cam 38 rotates on pivot pin 48 and drives locking yoke actuator 25 through drive pin 46 as pin 46 moves across actuator 25 through drive slot 45. Also, locking yoke activator 25 moves on pivot pin 48 through clearance slot 47. Slots 45 and 47 are contained in locking yoke actuator 25. Cam pivot pin 48 is mounted in housing 20 while cam linkage pin 46 travels through a clearance slot 50 in housing 20.

The disengagement of locking yoke 23 from engagement pins 40 releases keeper 21 and permits the movement of door 32 and its latch bolt 30 to move from door locked position to door open position as shown in FIG. 6. As the door opens, latch bolt 30 contacts keeper 21 rotating it toward the door open position. When latch bolt 30 clears keeper 21, the keeper return spring 26, FIGS. 9 and 10, moves the keeper toward its closed position. Interaction of the Geneva mechanism components 43 and 42 on keeper 21 and locking yoke 23, respectively, ensure that locking yoke 23 cannot return to its locked position until keeper 21 has fully closed. Additionally, with the Geneva mechanism or movement positioned as shown in FIG. 8, separate locking means is provided by the Geneva mechanism. As used herein, the Geneva mechanism comprises a stop formed by two interfering cams 42 and 43 formed one on each leg of locking yoke 23, Cam 42 inhibits rotation of keeper 21 depending on the rotational position of the mating parts.

Fail Secure Operation

In the fail secure mode, solenoid 14 is oriented in operating module 13 so that with power off connector link 39 is extended out of the operating module 13 thereby locking the electric strike (FIGS. 7 and 8). Application of power to solenoid 14 serves to push connector link 39 into the operating module 13 thus unlocking the electric strike (FIGS. 5 and 6).

Fail Safe Operation

To operate in the fail safe mode, solenoid 14 is reversed, end to end, in the operating module 13. With this orientation, if power is off connector link 39 is retracted into the operating module 13 (by means of conical spring 28) and the electric strike is unlocked (FIGS. 5 and 6). With the application of power, connector link 39 is extended from module 13 thus locking the electric strike (FIGS. 7 and 8).

Although but two embodiments of the invention have been illustrated and described, it will be apparent to those skilled in the art that various changes and modifications may be made therein without departing from the spirit of the invention or from the scope of the appended claims.

What is claimed is:

1. A door locking mechanism comprising:

a strike block adapted to receive a latch bolt, a pivotal keeper comprising pin means for selectively opening and closing said strike block, a first spring means acting on said keeper for biasing said keeper to a locked position, solenoid means positioned in said block and having a plunger extending therefrom and a second spring means mounted around said plunger for biasing said plunger outwardly of said solenoid means, pivot means mounted in said block for arcuate reciprocal movement from a first position to a second position under the action of said plunger of said solenoid means and from said second position to said first position under the action of said second spring means, said pivot means having a slot for engagement with said pin means on said keeper when said solenoid means is deenergized, an actuator means pivotally mounted on said block for engagement with said plunger of said solenoid means at one end thereof and with said pivot means at the other end, said solenoid means when electrically energized rotating said actuator means to cause it to engage and arcuately move said pivot means, said pivot means upon arcuate movement to said second position removing its slot from around said pin means to release said keeper rendering it movable by a door latch to its open position and sequentially under the action of said first spring means moving it back to its locked position.

2. The door latching mechanism set forth in claim 1 wherein:

said pivot means comprises a locking yoke, said locking yoke comprises a pair of spaced slots, and said pin means comprises a pair of spaced pins one for engaging with each of said slots in said locking yoke.

3. The door latching mechanism set forth in claim 1 in further combination with:

a locking means comprising interfering cams one mounted on said keeper and one mounted on said locking yoke which prohibit said locking yoke from returning to its locked position until said keeper returns to its closed position and is ready to be locked.

4. A door locking mechanism comprising:

a strike block adapted to receive a latch bolt, a pivotal keeper for selectively opening and closing said strike block and comprising pin means, a keeper return spring acting on said keeper for biasing said keeper to a locked position, solenoid means positioned in said block so that when energized the keeper is free to move to an open and unlocked position and having a plunger extending therefrom and a plunger return spring mounted around said plunger for biasing said plunger outwardly of said solenoid means thus allowing said keeper to move to a closed and locked position when the solenoid means is deenergized, a locking yoke mounted in said block for arcuate reciprocal movement from a first position with the solenoid means deenergized to a second solenoid position with the solenoid means energized, said locking yoke having a slot for engagement with said pin means on said keeper to lock said keeper in a given position, an actuator means reciprocally mounted on said block for engagement with said plunger of said solenoid means at one end thereof and with said locking yoke at the other end, said solenoid means when electrically energized sliding said actuator means to cause it to arcuately move said locking yoke to the unlocked position, said locking yoke upon arcuate movement to said second solenoid position removing its slot from around said pin means to release said keeper rendering it movable by a door latch to its open and unlocked position and sequentially under the action of said deenergized solenoid means moving it back to its closed and locked position.

5. The door locking mechanism set forth in claim 4 in further combination with:

a locking means comprising interfacing cams one mounted on said keeper and one mounted on said locking yoke which prohibit said locking yoke from returning to its locked position until said keeper returns to its closed position and is ready to be locked.

6. A door locking mechanism comprising:

a strike block adapted to receive a latch bolt , a pivotal keeper for selectively opening and closing said strike block and comprising pin means, a keeper return spring acting on said keeper for biasing said keeper to a closed and locked position, solenoid means positioned in said block so that when energized said keeper is in a closed and locked position and having a plunger extending therefrom and a plunger return spring mounted around said plunger for biasing said plunger outwardly of said solenoid means thus allowing said keeper to move to an open and unlocked position when the solenoid is deenergized, a locking yoke mounted in said block for arcuate reciprocal movement from a first position with said solenoid means energized to a second solenoid deenergized position under the action of said solenoid means, said locking yoke having a slot for engagement with said pin means on said keeper to lock said keeper in said first position, and an actuator means reciprocally mounted on said block for engagement with said plunger of said solenoid means at one end thereof and with said locking yoke at the other end, said solenoid means when electrically energized sliding said actuator means to cause it to arcuately move said locking yoke to the locked position, said locking yoke upon arcuate movement to said second deenergized position removing its slot from around said pin means to release said keeper rendering it movable by a door latch to an open and unlocked position and sequentially under the action of an energized solenoid means moving it back to a closed and locked position.

7. The door locking mechanism set forth in claim 6 in further combination with:

a locking means comprising interfering cams one mounted on said keeper and one mounted on said locking yoke which prohibit said locking yoke from returning to its locked position until said keeper returns to its closed position and is ready to be locked.

8. A door locking mechanism comprising:

a strike block adapted to receive a latch bolt, a pivotal keeper for selectively opening and closing said strike block and comprising pin means, a keeper return spring acting on said keeper for biasing said keeper to a closed and locked position, solenoid means positioned in said block and having a plunger extending therefrom and a plunger return spring mounted around said plunger for biasing said plunger outwardly of said solenoid means, a U-shaped locking yoke mounted in said block for arcuate reciprocal movement from a first position to a second position under the action of said solenoid means, said locking yoke having a pair of slots one in each leg of the U-shaped locking yoke for engagement with said pin means on said keeper to lock said keeper, and an actuator means reciprocally mounted on said block for engagement with said plunger of said solenoid means at one end thereof and with said locking yoke at the other end, said solenoid means when electrically energized sliding said actuator to cause it to arcuately move said locking yoke, said locking yoke upon arcuate movement to said second deenergized position removing its slot from around said pin means to release said keeper rendering it movable by a door latch to an open and unlocked position and sequentially under the action of said solenoid means moving it back to a closed and locked position.

9. The door locking mechanism set forth in claim 8 in further combination with:

a locking means comprising interfering cams one mounted on said keeper and one mounted on said locking yoke which prohibit said locking yoke from returning to a locked position until said keeper returns to a closed position.

* * * * *